US007213828B2

(12) United States Patent
Riepler et al.

(10) Patent No.: US 7,213,828 B2
(45) Date of Patent: May 8, 2007

(54) BOARD-TYPE RUNNER DEVICE AND TOP LAYER AND RUNNING SURFACE LINING FOR SAME

(75) Inventors: Bernhard Riepler, Wagrain (AT); Georg Klausner, St. Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 0 days.

(21) Appl. No.: 10/255,165

(22) Filed: Sep. 25, 2002

(65) Prior Publication Data

US 2003/0094787 A1 May 22, 2003

(30) Foreign Application Priority Data

Oct. 1, 2001 (AT) ..... A 1552/2001

(51) Int. Cl.
*A63C 5/04* (2006.01)

(52) U.S. Cl. ..... 280/609; 280/14.22

(58) Field of Classification Search ..... 280/601, 280/609, 610, 14.21, 14.22, 14.24, 87.041
See application file for complete search history.

(56) References Cited

U.S. PATENT DOCUMENTS

| | | | | | |
|---|---|---|---|---|---|
| 2,581,532 | A | * | 1/1952 | Hem | 280/610 |
| 3,369,821 | A | * | 2/1968 | Weber | 280/610 |
| 3,408,086 | A | * | 10/1968 | Bennett | 280/604 |
| D221,262 | S | * | 7/1971 | Marshal | D21/769 |
| 3,933,360 | A | * | 1/1976 | Arai | 280/609 |
| 4,118,050 | A | * | 10/1978 | Schnurrenberger | 280/604 |
| 4,223,909 | A | * | 9/1980 | Danner et al. | 280/604 |
| 4,714,266 | A | * | 12/1987 | Feichtlbauer | 280/604 |
| 4,752,260 | A | * | 6/1988 | Stewart | 441/65 |
| 4,919,447 | A | * | 4/1990 | Jackson et al. | 280/604 |
| 4,993,740 | A | * | 2/1991 | Recher et al. | 280/610 |
| 5,052,963 | A | | 10/1991 | Johnson, III | 441/68 |
| 5,141,243 | A | * | 8/1992 | Meatto | 280/602 |
| 5,167,552 | A | * | 12/1992 | Johnson, III | 441/74 |
| 5,238,434 | A | | 8/1993 | Moran | 441/74 |
| 5,725,237 | A | * | 3/1998 | Krafft et al. | 280/609 |
| 5,788,259 | A | * | 8/1998 | Emig | 280/609 |
| D428,459 | S | * | 7/2000 | Broz et al. | D21/769 |
| 6,182,986 | B1 | * | 2/2001 | Smith | 280/87.042 |
| 6,357,781 | B1 | * | 3/2002 | Jeandin | 280/609 |
| 6,460,868 | B2 | * | 10/2002 | Madrid | 280/87.042 |

FOREIGN PATENT DOCUMENTS

| | | | | |
|---|---|---|---|---|
| AT | 200046 | * | 10/1958 | 280/601 |
| CA | 572337 | * | 3/1959 | 280/610 |

(Continued)

*Primary Examiner*—Christopher P. Ellis
*Assistant Examiner*—Bridget Avery
(74) *Attorney, Agent, or Firm*—Collard & Roe, P.C.

(57) ABSTRACT

In a ski, jumping ski or snowboard comprising a running surface lining, a top layer and several layers disposed between the running surface lining and the top layer, the running surface lining and the top layer having an external face facing away from the core, at least one of the external faces has an at least partially structured surface with a plurality of recesses. The recesses have a depth smaller than the thickness of the running surface lining and the top layer, and an annular rounded transition region surrounds the recesses, the rounded transition region having an arcuate contour which is convex relative to the external face.

14 Claims, 11 Drawing Sheets

FOREIGN PATENT DOCUMENTS

| | | | | |
|---|---|---|---|---|
| CH | 153866 | * | 7/1932 | ..... 280/610 |
| DE | 833 168 | * | 3/1952 | ..... 280/610 |
| DE | 90 18 169 | | 10/1990 | |
| FR | 1313899 | * | 11/1962 | ..... 280/610 |
| FR | 2 534 479 | | 10/1983 | |
| FR | 2534479 | | 4/1984 | |
| FR | 2800622 | | 5/2001 | |
| JP | 52-6239 | * | 1/1977 | ..... 280/610 |

* cited by examiner

BOARD-TYPE RUNNER DEVICE AND TOP LAYER AND RUNNING SURFACE LINING FOR SAME

FIELD OF THE INVENTION

The invention relates to a board-type runner device, in particular a ski, jumping ski or snowboard, having several layers arranged between a running surface lining and a top layer, forming a sandwich element with a core disposed in between, as well as a layer of transparent or translucent plastics material for forming an external top layer or the running surface lining of a board-type runner device, in particular a ski, jumping ski or snowboard, as one of the components for a runner device of this type.

THE PRIOR ART

A plurality of board-type runner or sports devices is known, in particular in the form of skis or similar, of which the finished top layers and running surface linings made from plastics are absolutely smooth or flat. Although this reduces the capacity of snow and ice to stick to these surfaces as far as possible, the gliding capacity of sports devices of this type is somewhat impaired as a result under genuine usage conditions.

OBJECTIVE AND ADVANTAGES OF THE INVENTION

The underlying objective of the present invention is to design of board-type runner device which can be made attractive in appearance without at the same time impairing its properties or performance and possibly in fact enhancing its performance.

This objective is achieved by the invention due to the fact that an external face of the top layer or the running surface lining or of the top layer and running surface lining remote from the core has an at least partially structured surface with a plurality of recesses or raised areas, a depth of the recesses being shorter than a thickness of the structured top layer or the structured running surface lining.

The advantage of this is that the cw value and the value of the coefficient of air resistance of the runner device can be improved by providing a finely structured surface, at least on the top layer. This improvement in the value of the coefficient of air resistance of the runner device as compared with totally smooth top layers can therefore also bring a slight improvement in the running performance of this runner device under ideal conditions. Similarly, the gliding properties of the runner device, in particular of the running surface lining, can be at least slightly improved by a finely structured gliding or outer surface, if the running surface lining is also provided with this same or a similar surface structure. Above all, also depending on the properties of the medium in contact with the running surface lining, in particular depending on the consistency and properties of the ice or snow, the gliding resistance of a runner device designed accordingly can be at least slightly reduced. The achievable improvements can be verified by exact measurements. Irrespective of improvements in performance values and technical properties, this surface structuring of the top face of the top layer and/or the running surface lining also achieve a not unattractive visual appearance, imparting a particularly distinctive, individual character to runner devices of this type. In view of the fact that there are no additional orifices in the outermost top layer and in the running surface lining, there is no increased risk of the sandwich element coming apart.

One possible embodiment of the board-type runner device, in which the top layer is designed to have 200 to 1000, preferably approximately 600 recesses per square decimetre ($dm^2$), advantageously secures a good compromise between a specific structured effect and an improvement in performance-related values.

In one embodiment, in which a ratio of recessed surface to prominent surface is approximately 1:1, the structuring of the top layer and/or the running surface lining is relatively more perceptible in visual terms, even when slightly deformed.

In one embodiment, a surface area of recessed surface in the top layer is larger than a surface area of prominent surface in the top layer, or a ratio of recessed surface to prominent surface is in the order of from approximately 1.2:1 to 2:1, striking an ideal balance between good visual appearance and an at least slight improvement in performance characteristics.

Recesses can quite easily be formed in the runner device during the production process and, as seen in plan view, the recesses will have a surface dimension of from 4 to 12 $mm^2$, preferably approximately 8 $mm^2$. In addition, the surface of the runner device can be virtually dotted with the desired structure.

The gliding resistance of the running surface lining can be reduced in one embodiment, in which a surface area of recessed surface in the running surface lining is smaller than a surface area of prominent surface in the running surface lining since the effective gliding and friction surface in contact with the ground is slightly reduced.

In another embodiment of the runner device, the recesses as viewed from above onto the runner device are of a circular or elliptical design, the advantage of this being that the curved boundary faces are conducive to flow and gliding behaviour.

The flow properties of the top layer and the gliding properties of the of the running surface lining can be still further improved by recesses of an elongate design as seen in plan view, the longitudinal extension thereof being aligned parallel with a longitudinal direction of the runner device.

Providing recesses of a triangular or polygonal, rectangular or rhomboid, hexagonal or honeycomb pattern as viewed from above will give the runner device a distinctive overall visual appearance in particular.

In one embodiment of the runner device, in which the recesses or raised areas are arranged in adjacent columns or rows or aligned in adjacent rows or columns offset from one another, an orderly and systematic distribution of recesses and raised areas can be achieved, which additionally provides a basis for exact reproducibility of the surface structure.

The range of possible visual patterns can be extended still further by continuously changing a surface density of the recesses or raised areas in the longitudinal direction of the runner device or by varying this surface density several times, or alternatively a surface density of the recesses or raised areas may be reduced, starting from a front region or tip region, relative to the direction of travel, towards a rear or tail region by reference to the direction of travel, or a surface density of recesses or raised areas may be increased or decreased in a linear or non-linear arrangement transversely to a longitudinal direction of the runner device, whilst optimising the characteristics of such a runner device to suit a variety of usage conditions or applications.

The technical and/or visual effect of the surface structure can be still further enhanced if individual part-regions of a top face or bottom face of the runner device are of a flat or smooth design.

In one embodiment of the runner device, the tip region and/or a binding mounting region is of a flat or smooth design, making those regions of the runner device on which a structured surface would bring barely any technical improvement immediately visually recognisable.

The visual appearance and design of the runner device can be varied in numerous ways and made more distinctive by providing recesses or raised areas of structured part-regions in the top face or bottom face, extending at least partially in the longitudinal direction and/or widthwise direction of the runner device.

An interesting visual appearance can be obtained which simultaneously has a conducive effect on the technical properties of the runner device in an embodiment in which differently shaped recesses or raised areas are provided within a limited surface unit of the top face or bottom face.

In terms of flow and gliding behaviour, the recesses may be advantageously formed by providing an arrangement of dimples or depressions with transition regions extending to the prominent surface.

A runner device that can be particularly well optimised in terms of its strength properties and as regards its static properties has a top face that is contoured transversely to the longitudinal direction and in particular has at least one cambered strip or at least one groove-type indentation.

Another advantageous embodiment is one in which the recesses and/or raised areas are formed by profiled pressing surfaces of a compression moulding tool during the compression moulding process used to produce the sandwich element or runner device, since this obviates the need to prepare components with a corresponding surface structure and instead the surface structure can be produced directly as part of the manufacturing process of the runner device.

The invention also relates to a covering, made in particular from transparent or translucent plastics, which is used as a top layer or as a running surface lining for a board-type runner device, in which at least one flat face has an at least partially structured surface with a plurality of recesses and raised areas, and a depth of the recesses is shorter than a thickness of the layer, the surface structured in this manner being designed to form an external face of the runner device.

The advantage of using a structured covering of this type is that it can impart a distinctive appearance to the resultant runner device and also brings at least a slight improvement in the technical properties. In particular, using the covering as a top layer can improve the cw value of a runner device made in this manner. The gliding resistance of a running surface lining which has a fine structured surface and the runner device provided therewith can be slightly reduced if its running surface has a running surface lining structured in this manner.

A surface structure with as few edges and burrs as possible can be obtained in the covering if the recesses are provided with a rounded contour as seen in plan view and/or transition regions between the recesses and the raised areas are rounded.

One advantageous solution to obtaining the desired surface structure but using simple technical means is to form the recesses or raised areas, by means of a surface-profiled roller with raised areas or recesses, during a rolling process.

By providing a covering in which the density of the material is higher in the recesses than on the raised areas advantageously enables the mechanical strength and visual appearance of the covering to be varied.

Another structure of the layer which enables the recesses and raised areas to be provided by simple ways and means is one in which a plurality of elements criss-cross with or extend transversely to one another, for example threads or fibres, in the form of a lattice or fabric joined in a form fit or positive arrangement or at least partially embedded, so that the areas in between the elements form the recesses in at least one surface of the covering or in the surface of the covering. Another advantage of this approach is that the elements, either integrated or adhered to the underside to produce contouring or structure, can simultaneously be used to provide an advantageous visual effect. This is particularly the case if the outermost top layer is made from transparent or translucent plastics. Furthermore, these elements may improve strength and tearing resistance if the elements assume a reinforcing function.

Another advantageous embodiment is one in which the side remote from the structured surface is provided with a decorative element produced by sublimation heat or thermal diffusion pressure or by applying a decorative film or several layers of decorative lacquer, since a covering can be prefabricated with the desired decorative features, thereby simplifying and speeding up the process of manufacturing a runner device decorated accordingly.

Finally, one embodiment of the covering has an advantage insofar as the recesses or raised areas are arranged in a defined geometric structure, which means that instead of having a random distribution of raised areas and recesses, the recesses and raised areas can be disposed in a pattern calculated to achieve a certain visual effect, as well as the fact that this will provide the opportunity to use any number of designs to produce an attractive visual appearance.

BRIEF DESCRIPTION OF THE DRAWINGS

The invention will be described in more detail below with reference to examples of embodiments illustrated in the appended drawings. Of these.

DETAILED DESCRIPTION

Figure 1:
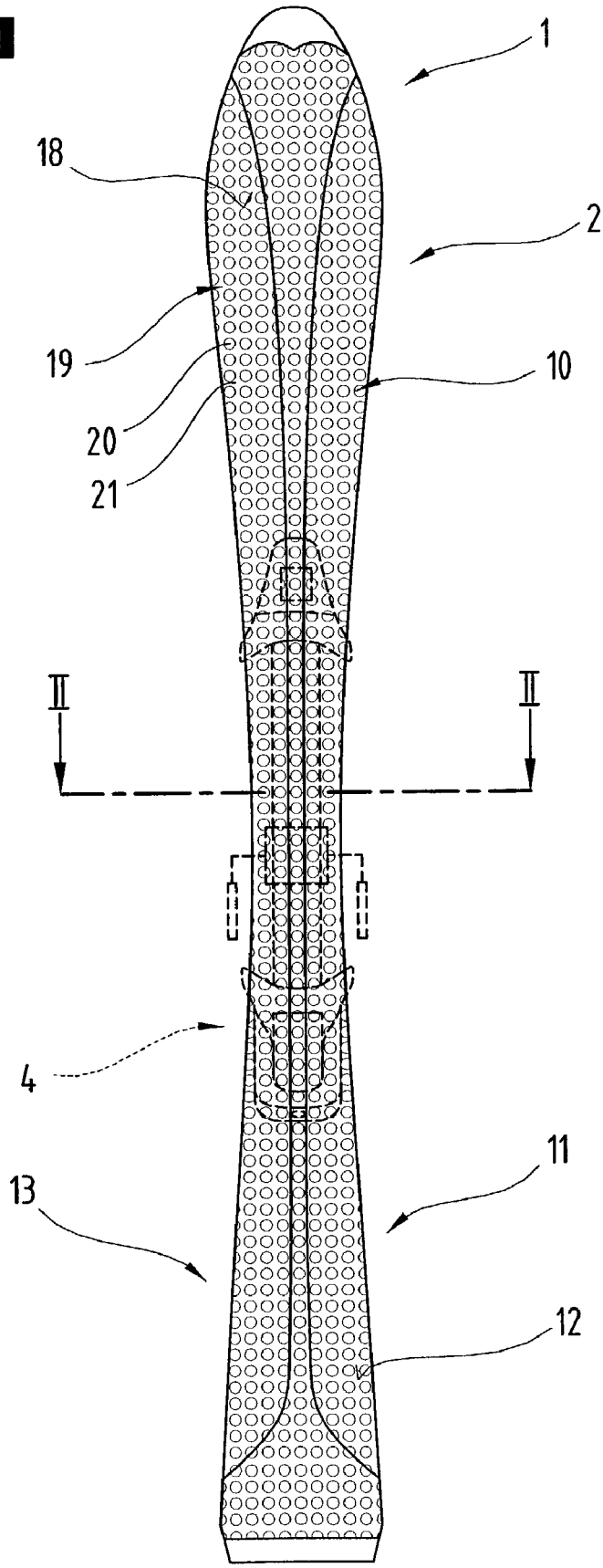
FIG. 1 is a highly simplified diagram, not to scale, showing a plan view of a board-type runner device, in particular a ski, with a three-dimensionally structured top face and a schematically indicated binding unit.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
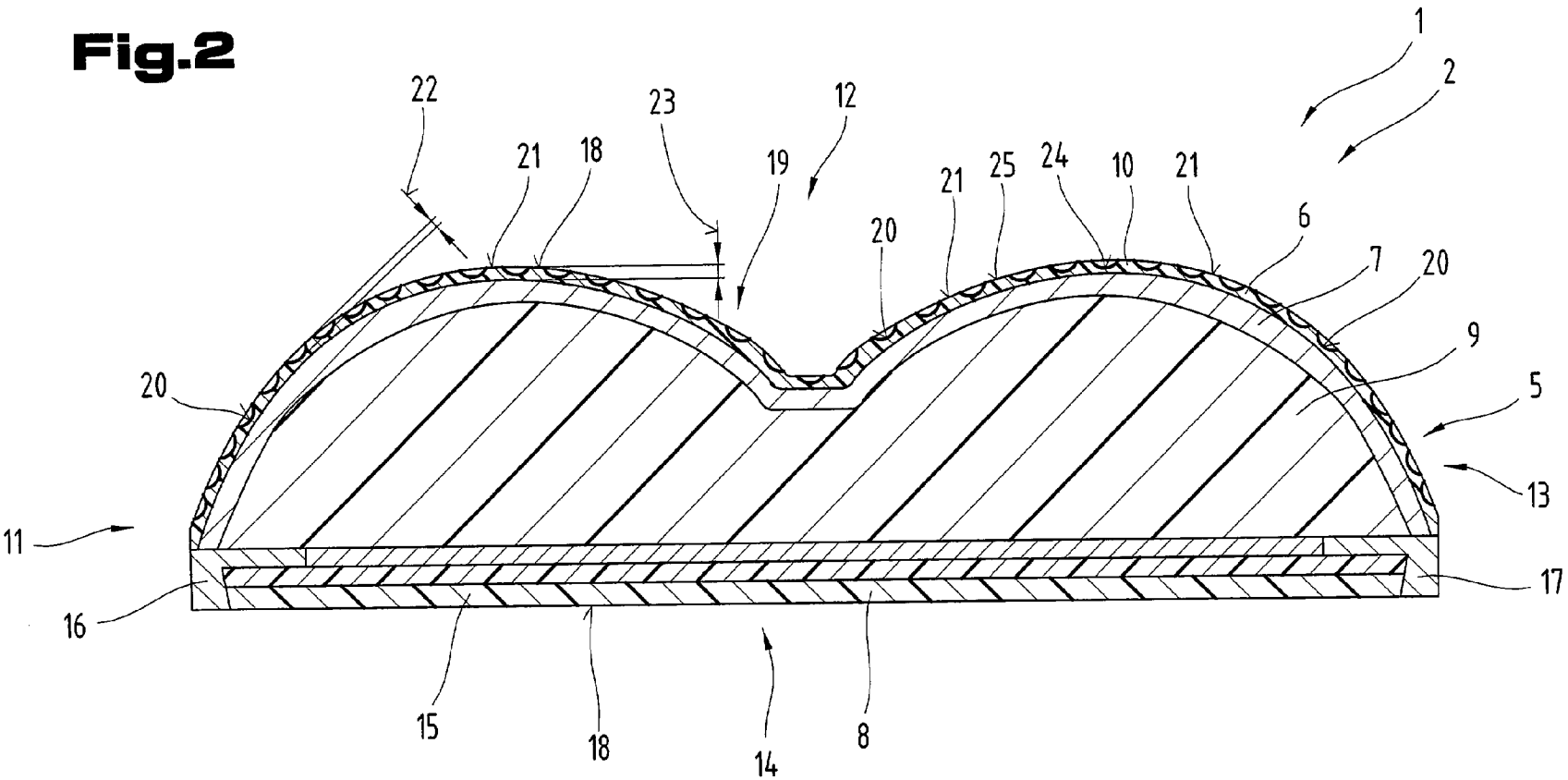
FIG. 2 is a highly simplified, schematic diagram showing a cross-section through the runner device illustrated in FIG. 1, along line II—II indicated in FIG. 1.
Figure 3:
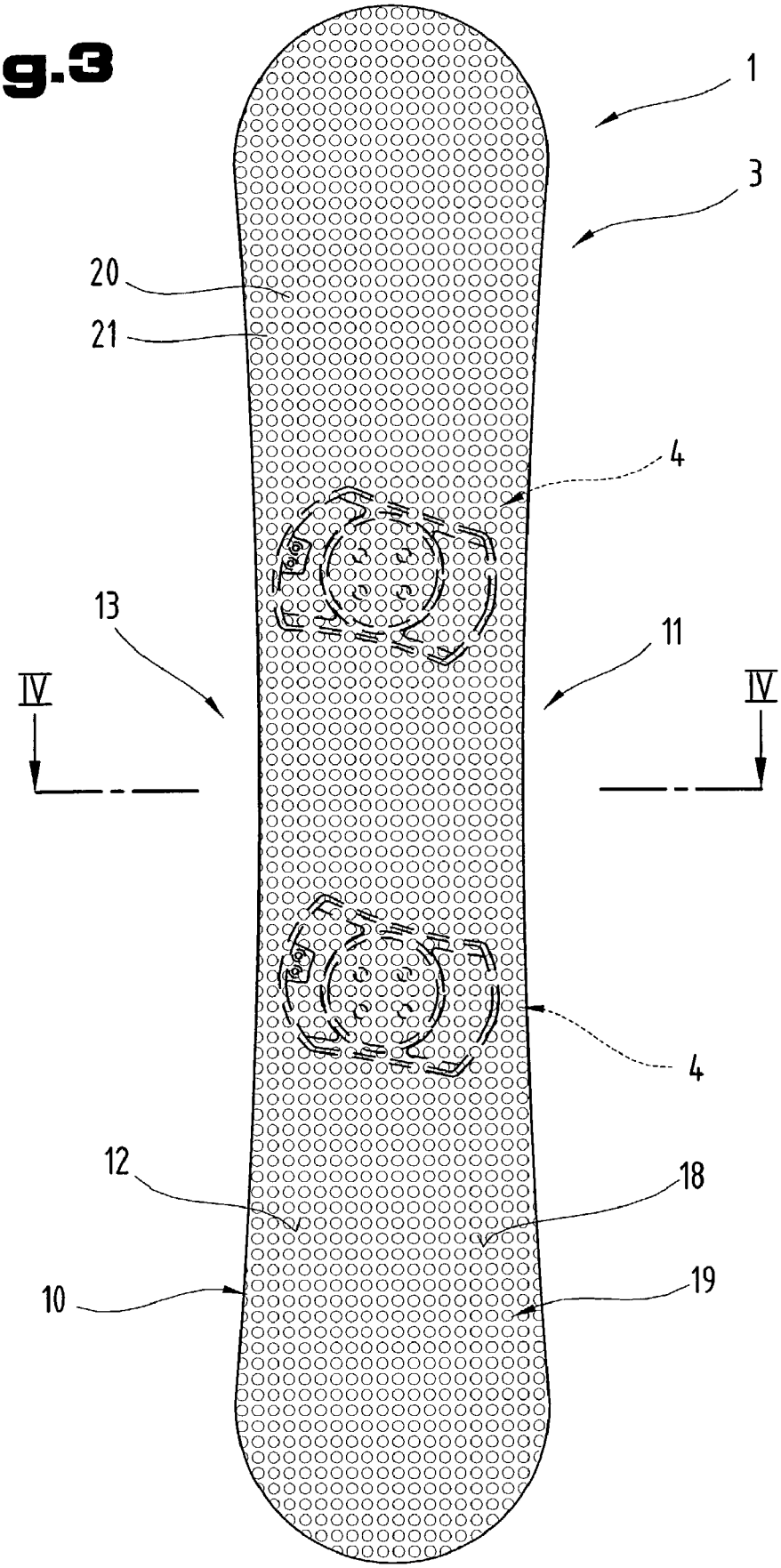
FIG. 3 is a highly simplified diagram, not to scale, specifically showing a plan view of a snowboard with a three-dimensionally structured top face and a schematically indicated binding unit.

FIGS. 1 to 4 illustrate two embodiments of a board-type runner device 1 for gliding on ice, snow or another appropriate surface. In particular, the runner devices 1 illustrated are sports apparatus used for winter sports, such as alpine skiing or snowboarding. FIG. 1 illustrates one possible embodiment of a ski 2, whilst the embodiment illustrated in FIG. 3 is one possible design for a snowboard 3. A generally standard binding unit 4, indicated by broken lines, is mounted on these runner devices 1 for detachably connecting the runner device 1 to the shoe and foot of a user, as necessary.

In a known manner, a runner device 1 of this type is made up of a multi-layered sandwich element 5, consisting of individual layers 6, 7, 8 joined to one another in a force and/or positive fit arrangement, preferably bonded, the ply or layer more or less in the middle having the biggest cross-sectional dimension relative to the outer layers, thereby forming a so-called core 9 of the sandwich element 5. The core 9 may be made from wood, in particular from several laminations bonded to one another to form an integral component, which are preferably made from a hard wood. Alternatively, the core 9 of the runner device 1 might also be made from an expandable synthetic material and/or by section-type elements made from light metal, carbon or similar.

Layers 6 and/or 7 and/or 8 in the outer peripheral region of the cross-section of the runner device 1 constitute the so-called top and/or bottom belt of the sandwich element 5 or runner device 1. These layers 6, 7, 8 are made from materials with a relatively high tensile strength, such as metal, in particular aluminium and/or titanium, and/or from resin-impregnated fabrics and essentially determine the mechanical properties, in particular the bending strength and/or breaking strength, of the runner device 1.

The outermost layer 6 in the embodiment illustrated as an example here constitutes a top layer 10 of the runner device 1. This uppermost top layer 10 is preferably made from plastics and is primarily intended to fulfil a decorative and protective function for the runner device 1. Alternatively, however, the top layer 10 could also be made from metal, in particular light metal, such as aluminium, titanium or similar, for example. The top layer 10 preferably extends in a shell-like arrangement from a first longitudinal side region II across the top face 12 to the other longitudinal side region 13 of the runner device 1. Instead of providing the top layer 10 in a shell-type design, it would naturally also be possible for the top layer 10 to be confined to the region within the top plane of the runner device 1, in which case the so-called side walls of the runner device 1 will be provided in the form of separate components, preferably made from plastics.

On a bottom face 14 of the runner device 1 remote from the top face 12 is a running surface lining 15, which is specifically designed to glide on the ground underneath, e.g. ice or snow. The running surface lining 15 is usually made from a plastics, of the type affording the least possible gliding resistance on snow or ice and having a sufficiently high resistance to scratching. The peripheral regions of the running surface lining 15 and the runner device 1 are bounded by generally sharp-edged elements 16, 17 of a relatively high hardness, e.g. steel. These sharp-edged elements 16, 17 form so-called steel edges which are intended to provide an exact and slip-free guiding action of the runner device 1 on ice or snow.

The essential feature is that at least an external face 18 of the top layer 10 remote from the core 9 has an at least partially structured surface 19. This three-dimensionally structured surface 19 is provided in the form of a plurality of small recesses 20 and/or raised areas 21. As may be seen by comparing FIGS. 1 to 4, these numerous or virtually innumerable recesses 20 and raised areas 21 extend exclusively through the outermost top layer 10 of the runner device 1. In particular, a depth 22 of the recesses 22 is shorter than a maximum thickness 23 or width of the top layer 10. Thin lacquered or decorative films and/or thin-layered films to reduce adhesion of ice or snow may also be provided on this top layer 10.

Alternatively or in combination with these numerous recesses 20 and raised areas 21 on the external face of the to layer 10, the externally lying face of the running surface lining 15 may also be provided with a geometric layout of recesses and/or raised areas, as will be explained in more detail below.

It has been found to be effective if the surface structure of the external top layer 10 of the runner device is provided with approximately 200 to 1,000, preferably approximately 600 recesses per $dm^2$. The depth 22 of the recesses 20 in the top layer 10 is always only a fraction, preferably less than half of the thickness 23 or maximum overall thickness of the top layer 10. Depending on the purpose for which the runner device 1 is intended and the medium on which the outer peripheries of the runner device 1 will flow or glide, i.e. either snow or air, a higher or lower surface density may be selected, i.e. the number of recesses 20 and raised areas 21 per surface unit.

As a result of the large number of recesses 20 and raised areas 21 on the top and/or bottom face 12, 14, the runner device 1 is virtually dotted in various sections with numerous, visually perceptible recesses 20 and raised areas 21.

A ratio of the sum of a recessed surface 24 to the sum of a prominent surface 25 may be approximately 1:1. In other words, the area of recessed surface 24 more or less corresponds to the area of prominent surface 25, by reference to a specific surface.

However, the area of recessed surface 24 in the top layer 10 may also be larger than the area of prominent surface 25 of the top layer 10 within a specific span of surface area of 1 $cm^2$ or 1 $dm^2$, for example. In particular, this ratio between recessed surface 24 and prominent surface 25 may be from approximately 1.2:1 to 2:1.

The surface density of the recesses 20 and raised areas 21 will primarily depend on the maximum size or surface area and the number of recesses 20 formed in the top layer 10.

Figure 4:
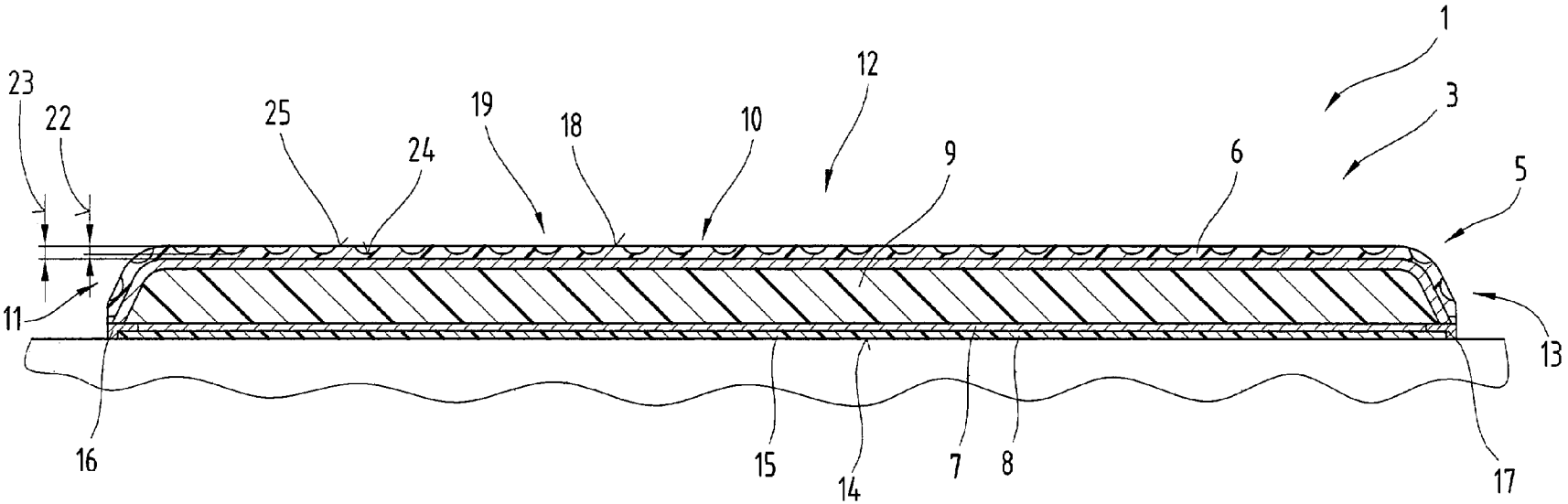
FIG. 4 is a simplified diagram showing a cross-section through the runner device illustrated in FIG. 3, along line IV—IV indicated in FIG. 3.

It has been found to be of advantage to provide recesses 20 which, seen in plan view as illustrated in FIG. 1 or 4, have a surface dimension of approximately 4 to 12 $mm^2$, preferably approximately 8 $mm^2$. In terms of flow resistance, it would be better, under certain circumstances, to provide recesses 20 with a surface dimension of less than 4 $mm^2$ and to increase their surface density, i.e. the number of recesses 20 per surface unit. However, the intended attractive overall impression or visual effect of the runner device does tend to be lost as a result. In particular, if the recesses 20 are too tiny, they are farther apart and no longer perceptible, which makes them less practical.

In particular, a structured top layer 10 of this type with three-dimensional recesses 20 and many so-called dimples or depressions gives the runner device 1 an attractive appearance. A snake skin or golf ball surface effect on the runner device 1, in particular, can produce very attractive visual effects.

As may be seen most clearly from FIG. 2 or 4, a widthwise and lengthwise dimension of the recesses 20 is preferably a multiple of the depth 22 of these recesses 20. In particular, the depth 22 is usually approximately 0.1 to 0.5 mm, whereas a lengthwise and widthwise dimension as seen in a plan view of the recesses 20 may be approximately 2 to 6 mm.

FIGS. 5 to 10 illustrate various possible embodiments of recesses 20 or raised areas 21 for a top layer 10 or a running surface lining 15 of a board-type runner device 1, of the type described above and schematically illustrated in a highly simplified form, not to scale, in FIGS. 1 to 4.

Figure 5:
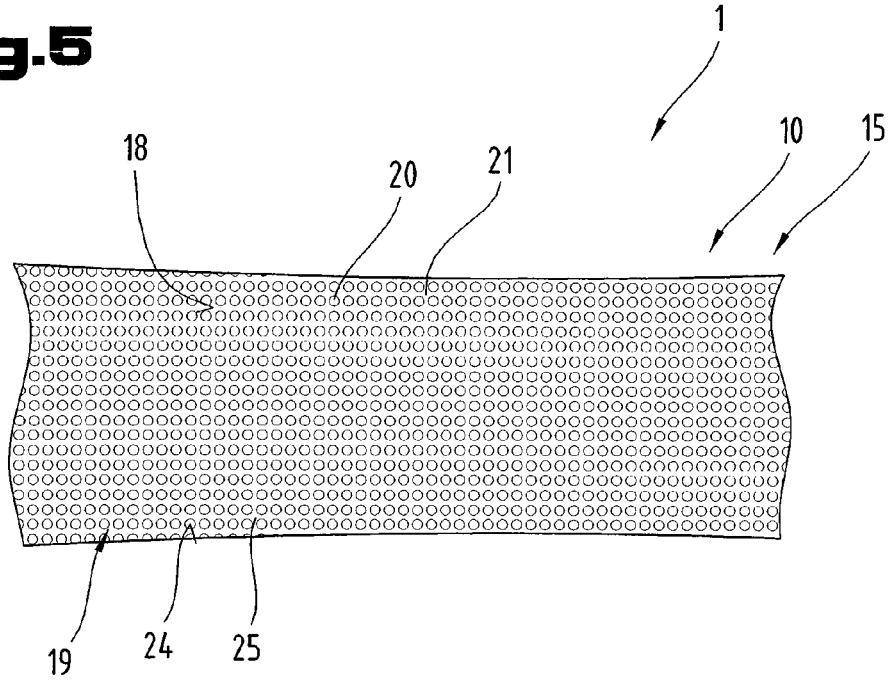
FIG. 5 shows a portion of an external top layer or a running surface lining for a board-type runner device, with geometrically arranged, three-dimensional recesses or raised areas.
Figure 6:
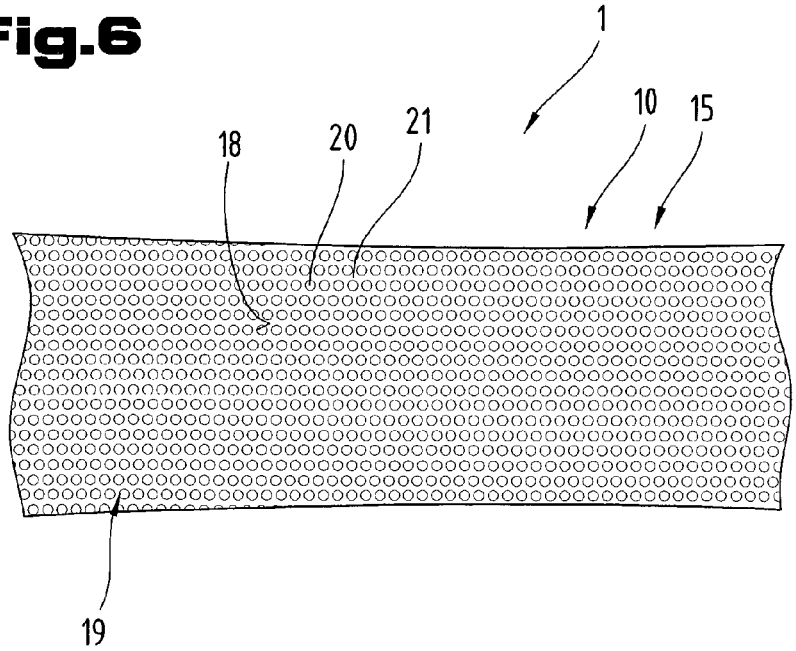
FIG. 6 shows an external top layer or a running surface lining for a board-type sports device with a different geometrical layout of recesses and raised areas.

As may be seen from FIGS. 5 and 6, the recesses 20 may be circular in shape, as viewed from above, and uniformly distributed across at least a flat face of the top layer 10 and the running surface lining 15. This uniform distribution of the recesses 20 and raised areas 21 may be based on a layout of columns and rows as illustrated in FIG. 5. However, an exact geometric layout and uniform distribution of the recesses 20 and raised areas 21 may also be obtained by a pattern recesses 20 and raised areas 21 arranged in columns and rows in which adjacent rows and/or columns are offset from one another, as illustrated in FIG. 6. This offset of the pattern in vertical directions is preferably half the distance between two recesses 20 of a row or column. Instead of an offset in two mutually perpendicular directions, it would also be possible to provide an offset in only one direction, for example in the longitudinal direction of the runner device 1, so that there is more or less half the dividing distance between two recesses 20 of a row.

Naturally, the recesses 20 and raised areas 21 could conceivably be distributed in other layouts that would produce a systematic arrangement or pattern.

The surface structuring is preferably dimensioned so that the numerous recesses 20 and raised 21 areas incorporated in the form of an indentation are tangible or perceptible to the touch when stroking the hand or a finger across the external face 18 or surface 19 of the runner device 1.

Figure 7:
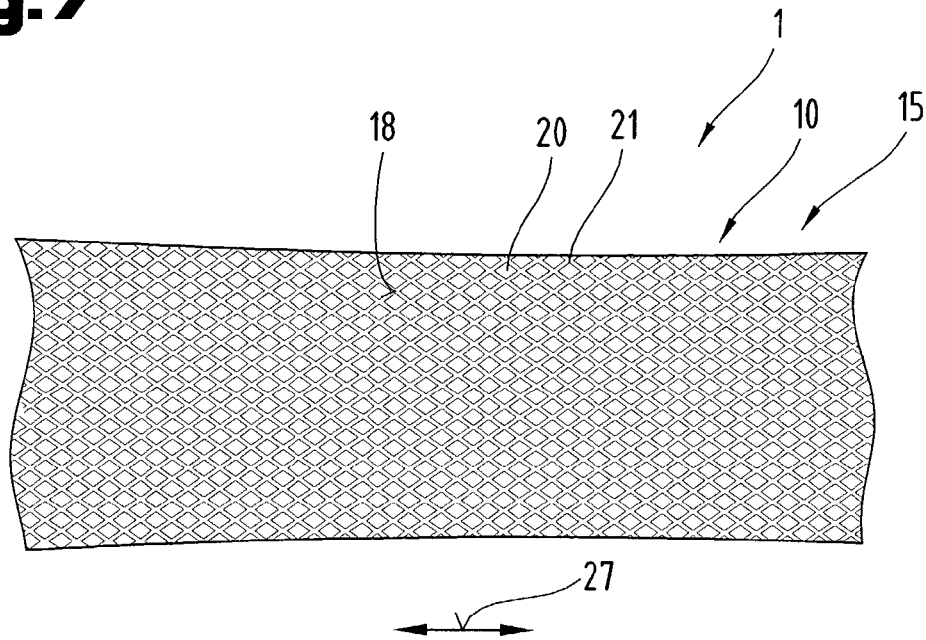
FIG. 7 is another surface structure for the top layer or the running surface lining of a board-type runner device.

FIG. 7 shows a plan view of rectangular-shaped, in particular lozenge-shaped recesses 20 in a top layer 10 or in a running surface lining 15 for a board-type sports device. The distribution of these rectangular or lozenge-shaped recesses 20 in geometric or specific pattern may also be slightly varied. In particular, the corner regions of the recesses 20 may be rounded and/or a higher or lower surface density selected.

Figure 8:
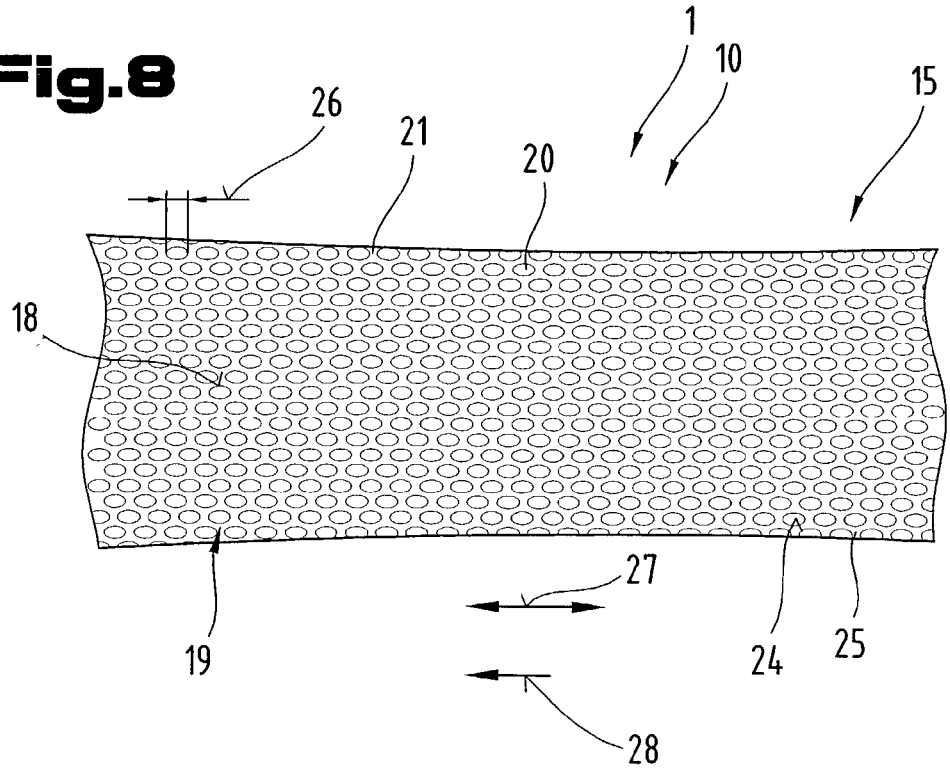
FIG. 8 is another three-dimensional surface structure for the external top layer or the running surface lining of a board-type runner device.

As illustrated in FIG. 8, the recesses in the top layer 10 or in the running surface lining 15 may be elliptical or egg-shaped as viewed from above. It has been found to be of advantage if these recesses 20, which are elongate when viewed from above, are disposed with their longitudinal extension 26 parallel with a longitudinal direction 27 of the runner device 2. Especially if using the design with elongate, in particular elliptical recesses 20, a plurality of linear recesses arranged in adjacent rows is provided transversely to the longitudinal direction 27 of the runner device 1, adjacent rows preferably being respectively offset by half the distance between two recesses 20 of a line or row.

Instead of a design with rounded or curved recesses 20, it would also be possible to provide a plurality of tiny raised areas or dots or nubs on the external flat face of the top layer 10 and the running surface lining 15.

Figure 9:
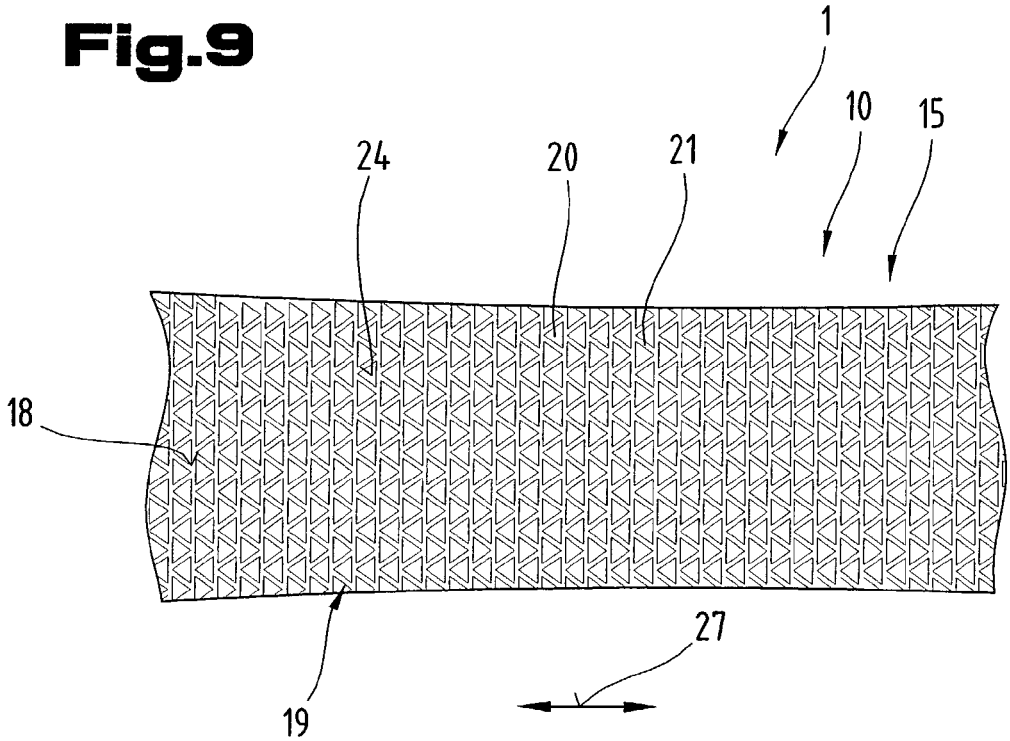
FIG. 9 is an other embodiment of a three-dimensional surface structure of a top layer or a running surface lining.
Figure 10:
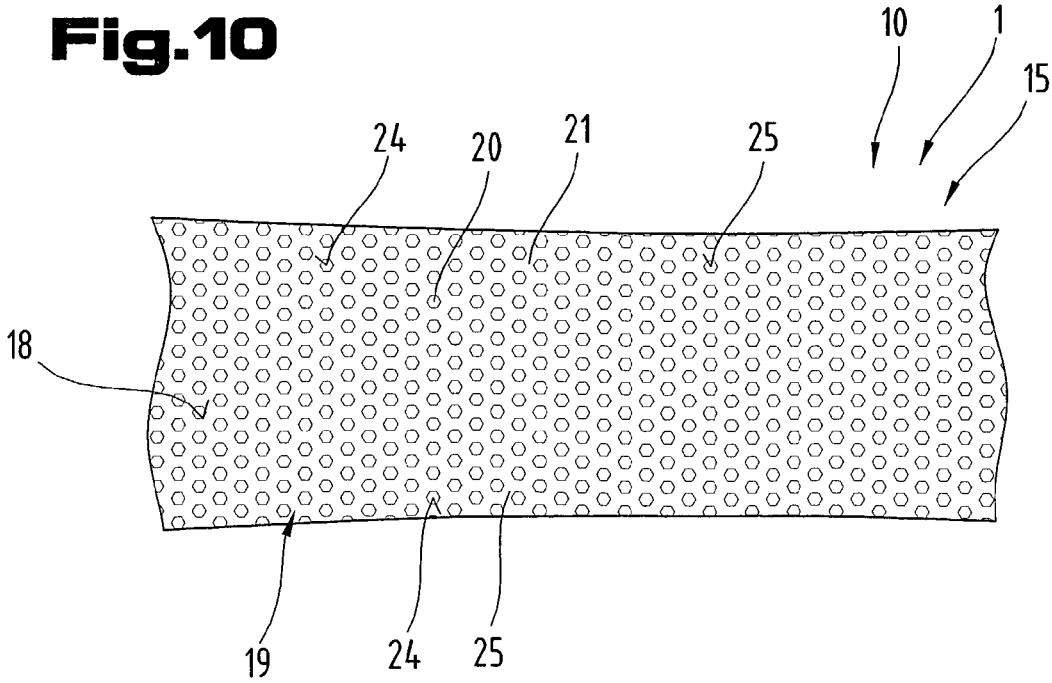
FIG. 10 is another embodiment of a surface structure for the top layer or a running surface lining.

As may be seen form FIGS. 9 and 10, the recesses 20 as seen in plan view may be of a triangular or polygonal design. Especially if the recesses 20 in the top layer 10 and in the running surface lining 15 are of a basic triangular shape, their mutual distribution and alignment will be selected so as to obtain intermediate regions or webs between adjacent recesses 20 forming a pattern that is as linear or lattice-like as possible. As may be seen from FIG. 10 in particular, these recesses 20 in the top layer 10 and in the running surface lining 15 may also be of a hexagonal or honeycomb design as seen in plan view. As is also most clearly illustrated in FIG. 10, the surface density of these recesses 20 may also be relatively low, in which case relatively large flat regions with a prominent surface 25 will be left between these recesses 20.

Figure 11:
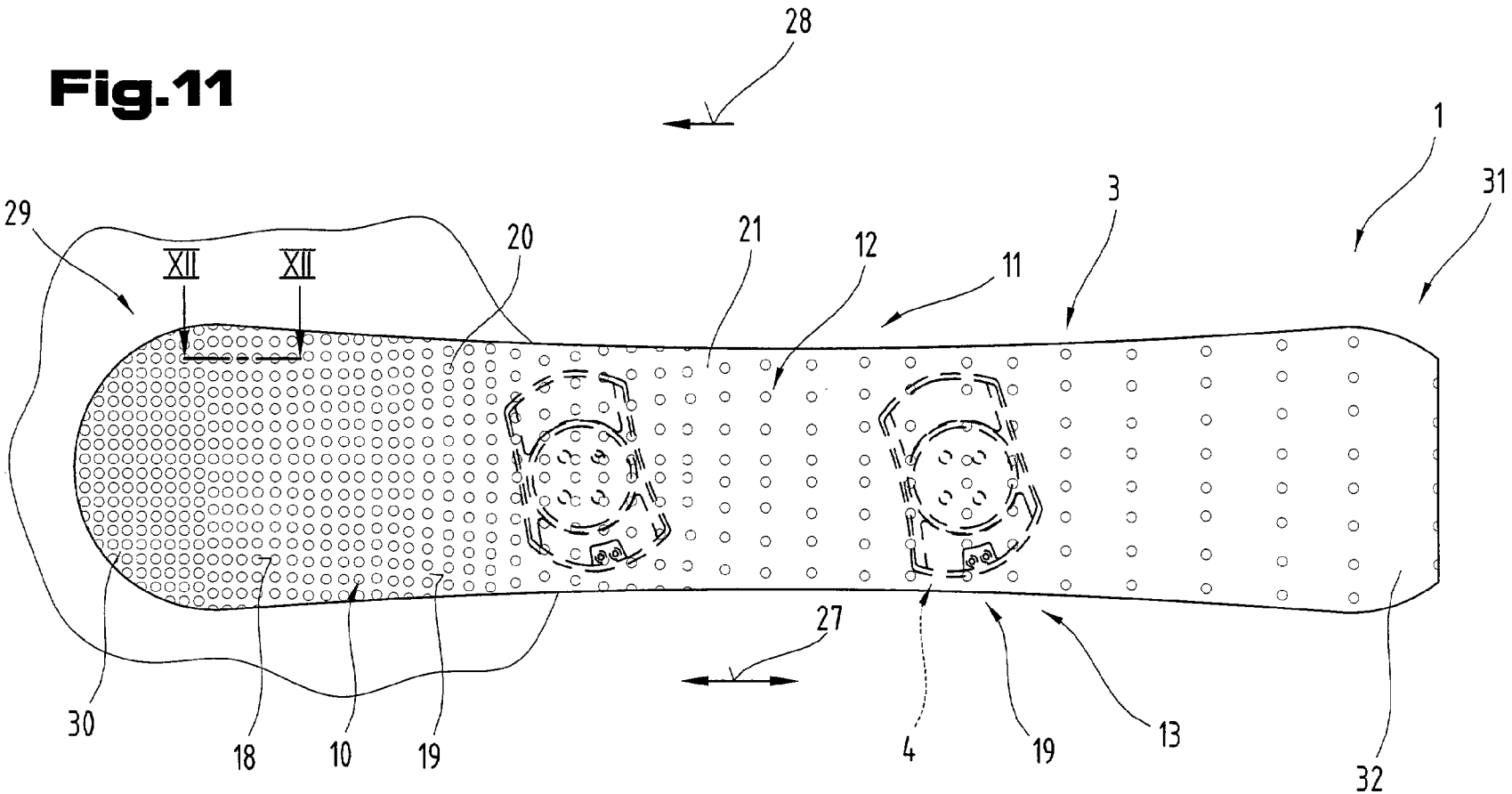
FIG. 11 is a simplified schematic diagram showing a plan view of another embodiment of a board-type runner device with a varying surface structure.

FIG. 11 illustrates another embodiment showing one possible distribution of the recesses 20 and raised areas 21 on the top face 12 of a runner device 1, for example a snowboard 3. In this case, a surface density of the recesses 20 or raised areas 21 varies in the longitudinal direction 27 of the runner device 1. In particular, the surface density of the recesses 20 or raised areas 21 varies almost continuously and as uniformly as possible in the longitudinal direction 27 of the runner device 1. In the embodiment illustrated as an example here, the surface density, i.e. the number of recesses 20 or raised areas 21 per surface unit, becomes lower, starting form a front region 29 or tip region 30 towards a rear region 31 or tail region 32, by reference to the usual direction of travel 28. Instead of constantly increasing or decreasing the surface density of the recesses 20 or raised areas 21 in the longitudinal direction 27 of the runner device 1, this surface density of recesses 20 or raised areas 21 could also be varied several times in the longitudinal direction 27 of the runner device 1, and in particular could consecutively increase or decrease.

Instead of or in combination with an increase or decrease in the surface density of the recesses 20 or raised areas 21 in the longitudinal direction 27 of the runner device 1, it would also be possible for the surface density of the recesses 20 or raised areas 21 to increase or decrease continuously or discontinuously transversely to the longitudinal direction 27 of the runner device, in other words in the direction of its width.

Figure 12:
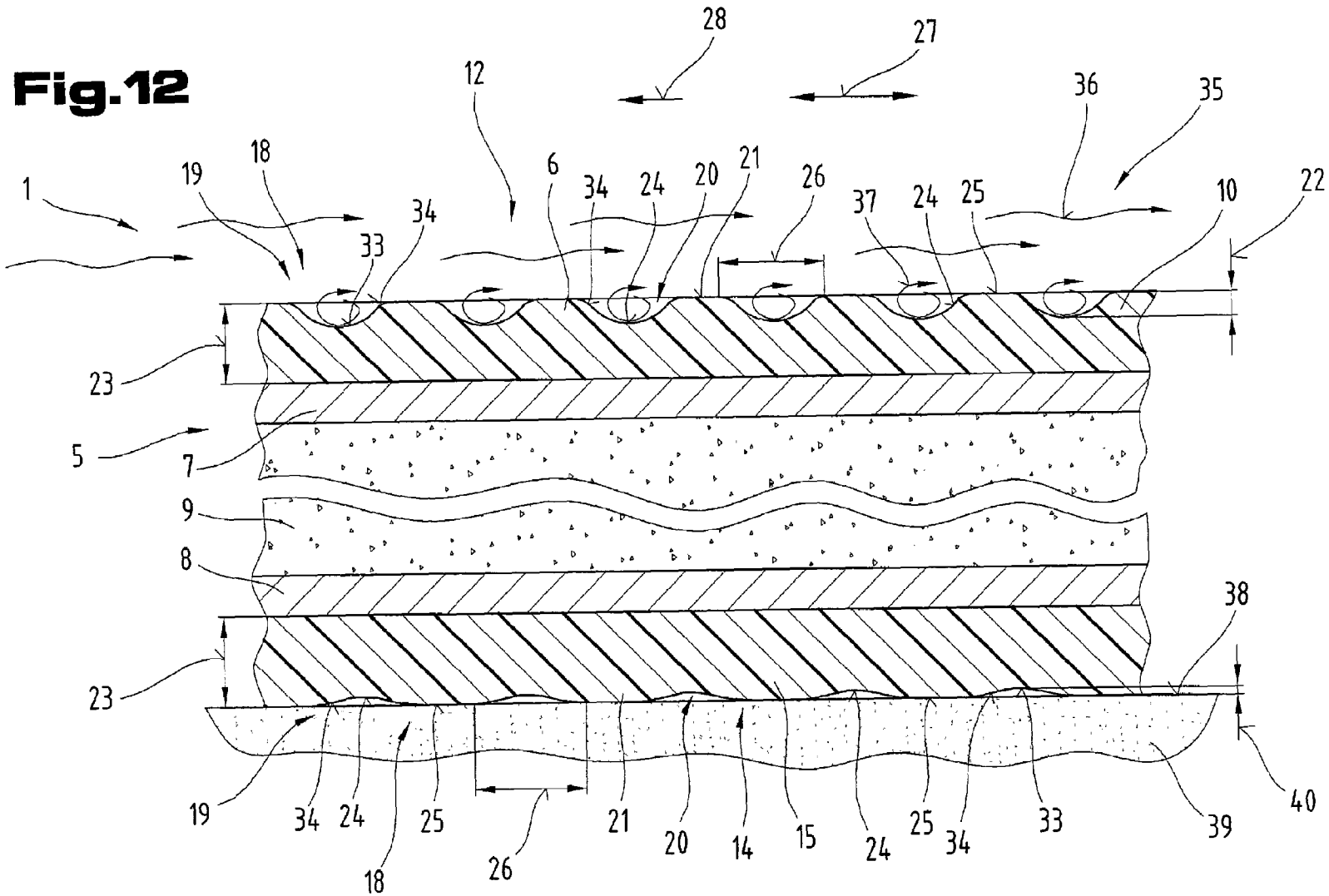
FIG. 12 is a simplified, schematic view showing a partial longitudinal section of the runner device illustrated in FIG. 11, along the line XII—XII indicated in FIG. 11.

FIG. 12 provides a highly simplified diagram, not to scale, of a longitudinal section through a part-region of the runner device 1 illustrated in FIG. 11. From this, it may be seen that the recesses 20 in the top layer 10 are provided with a dimple-shaped or spherically shaped longitudinal section and cross-section. A base 33 of the recesses 20 set back from the prominent surface 25 is preferably rounded or curved, imparting a shape that is conducive to flow properties. Furthermore, it is also preferable if a transition region 34 is provided in an annular arrangement around the recesses 20, in particular a rounded transition region 34 between the recessed surfaces 24 and the prominent surfaces 25 relative thereto. The boundary surfaces of the recesses 20 have an arcuate contour which is convex relative to the external face 18 so that these recesses 20 result overall in the shape of so-called pools or sprue holes or spherical depressions.

A surface structure of this type reduces the flow resistance of the runner device 1 as compared with a runner device 1 in which the external face 18 of the top layer 10 is smooth or absolutely flat. In particular, the cw value can be improved by the numerous recesses 20 and raised areas 21 on the external face 18 of the top layer 10 of the runner device 1. Accordingly, there will be less resistance to flow 35, in particular an air flow 36, such as occurs along the top face 12 of the runner device 1 during travel. In particular, defined eddy flows 37 may be generated in the recesses 20 or between corresponding raised areas 21, which will improve the passage of layers or air and surrounding flow 35 over that of an absolutely smooth surface. Consequently, during travel, there will be less resistance acting against the motion of the runner device 1.

As may also be seen from FIG. 12, recesses 20 and raised areas 21 of this type may also be provided directly in the running surface lining 15, which will reduce the flow resistance of the medium with which it is in contact, in particular snow or ice. Selectively and geometrically defined recesses 20 in the running surface lining 15 will specifically bring a slight improvement in its gliding resistance relative to the corresponding ground underneath 38, for example snow 39 and/or ice. This being the case, an area of recessed surface 24 in the running surface lining 15 will be smaller than an area of prominent surface 25 in the running surface lining 15. The primary reason for this is that the running surface lining 15 comes into contact with a relatively solid and compacted medium, whereas the top layer 10 interacts with a gaseous medium, in particular air. Consequently, the depth 40 of the recesses 20 in the running surface lining 15 is preferably shorter than a depth 22 of the recesses 20 in the top layer 10.

By providing recesses 20 in the running surface lining 15, a virtual air cushion can be generated between the ground, in particular the snow or ice, and the bottom face 14 of the runner device 1 when the runner device 1 is travelling. Consequently the gliding capacity of a runner device of this type 1 will be somewhat better than a runner device with an absolutely smooth running surface. In particular, an air flow will be directed from the tip region, underneath the running surface 15 into the fine recesses 20, as a result of which the runner device 1 will be raised higher off the ground by the relatively more intense "air cushion", thereby slightly reducing its flat contact with the ground during travel.

Figure 13:
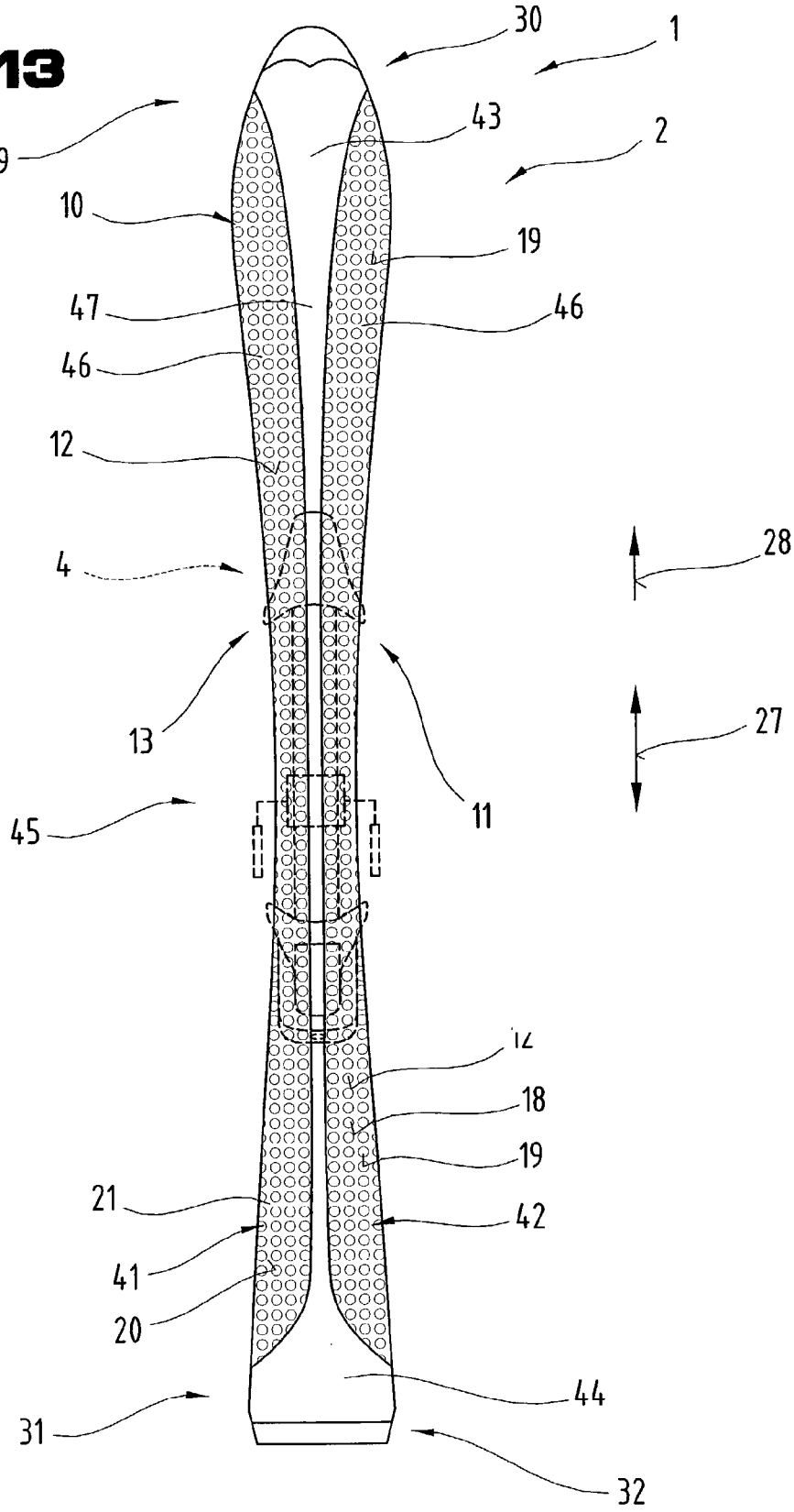
FIG. 13 is a simplified diagram showing an example of another embodiment of a runner device, with a partially structured top face.

FIG. 13 illustrates another embodiment of a runner device 1 or a ski 2 with a structured surface 19. The descriptions given above may be applied to same parts denoted by the same reference numbers. In this instance, only individual part-regions 41, 42 of the top face 12 of the runner device 1 have a three-dimensional structure or are provided with numerous fine recesses 20 and raised areas 21. The remaining part-regions 43, 44 of the top face 12 of the runner device 1 are of a planar design which is as smooth as possible, in a known manner. These planar or smooth part-regions 43, 44 may be provided in the tip region 30 and/or in the tail region 32 and/or in the binding mounting region 45. Naturally, however, the layout of structured and smooth surface regions could also be reversed. The advantage is that detrimental adhesion of ice or snow on the top face 12 can be minimised in the regions which are critical in this respect, whilst at the same time imparting an attractive visual appearance.

For example, the part-regions 41, 42 of the top face 12 with recesses 20 or raised areas 21 could extend at least partially in the longitudinal direction 27 and/or in the widthwise direction of the runner device 1, as illustrated in FIG. 13.

Above all the tips or end regions of the runner device 1 may be left without a surface structure in the top layer 10 extending virtually across the entire length and width of the runner device 1.

Another possibility would be to provide recesses 20 or raised areas 21 of different designs within a predetermined surface unit of the top face 12 of the runner device 1.

The structured surface 19 is primarily effective with runner devices 1 having a contoured top face 12, as may be seen, amongst other things, in FIG. 13. However, the design with a densely structured surface 19 is not in any way restricted to the top face 12 of contoured runner devices 1, and runner devices 1 of an approximately trapezoid-shaped cross section may naturally also be provided with the corresponding structured surface 19.

Of particularly practical effect is the design of a structured surface 19 or top layer 10 with three-dimensional recesses 20 and raised areas 21 in densely arranged rows on a runner device 1 which has at least one cambered strip 46 or at least one groove-type indentation 47 running along its longitudinal direction 27.

Similarly, another possibility would be to provide individual regions of a runner device 1 with raised areas 21 protruding out from an initial plane, in particular the layer plane, whilst other regions of the runner device 1 may be provided with a plurality of recesses 20 set back from this layer plane. For example, such raised areas 21 may be provided in the indentation 47 mentioned above, whilst the recesses 20 would be provided in raised contoured regions of the runner device 1 with a profiled cross-section, in particular on its cambered strips 46.

By preference, the structured top layer 10 is a prefabricated component, in particular a separate covering or layer to be incorporated during subsequent manufacture of the board-type runner device 1. In particular, the recesses 20 or raised areas 21 may be incorporated on at least a flat face of the top layer 10 made from plastics, by means of a roller having corresponding raised areas and recesses, during a rolling process or shaping process. It has been found that one particularly advantageous approach is to process the plastics layer or top layer 10 immediately after the extrusion process by means of an appropriately structured roller. This process of shaping the top layer 10 or also for a running surface lining 15 (see FIG. 12) is preferably effected using a so-called calender, of which at least one shaping roller will have the corresponding desired surface structure. By shaping the plastics film subsequently in this manner, the recesses 20 may have a higher density of material than the raised areas 21, depending on the degree to which the plastics is compressed. This produces an interesting optical effect since the raised areas 21 will exhibit a different transparency to light than the recesses 20, not least because of the thicker layer of material.

The synthetic film or layer produced in this manner will then constitute one of the initial products needed to manufacture a multi-layered runner device 1 by means of a heat press.

Instead of prefabricating these recesses 20 and raised areas 21 on a special plastics layer or film, it would also be possible to form the recesses 20 and/or raised areas 21 on the top face 12 and/or on the bottom face 14 (see FIG. 12) of the runner device 1 by means of appropriately structured pressing surfaces of a compression moulding tool. This being the case, the desired contour of the compression moulding tool or the compression moulding halves is transferred to the external faces 18, in particular to the top layer 10 and/or the running surface lining 15 (see FIG. 12) during the process of compressing the sandwich element 5 or producing the runner device 1 by increasing the pressure and/or increasing the temperature in a heat press. Particularly if producing structured surfaces 19 during the compression stage of making the runner device 1 or when manufacturing the sandwich element 5 (see FIG. 12), it will be possible to provide only specific part-regions 41, 42 of the top face 12 and/or the bottom face 14 (see FIG. 12) of the runner device 1 with a structured surface 19 as desired.

Figure 14:
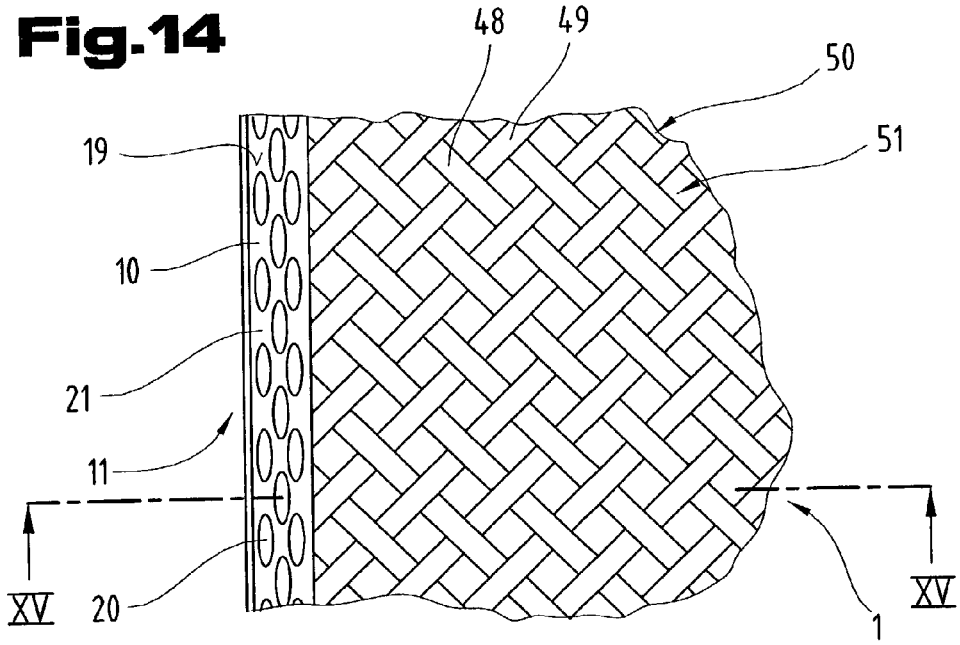
FIG. 14 is a diagram in section showing a plan view of a runner device with an interwoven arrangement or lattice disposed underneath the top covering, viewed in section along line XIV—XIV indicated in FIG. 15.
Figure 15:
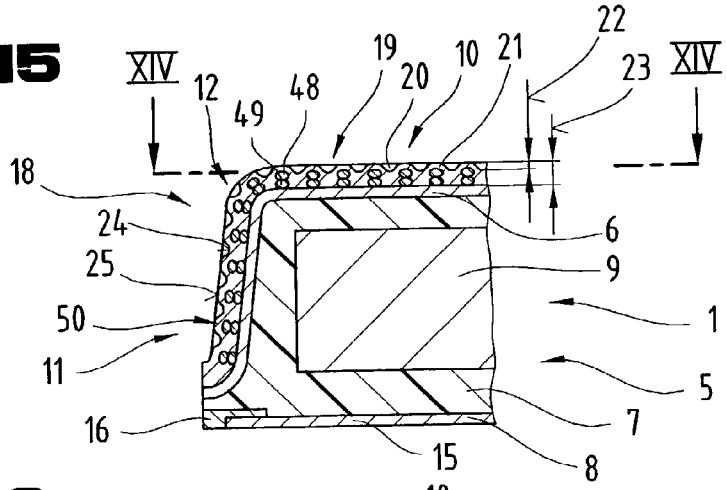
FIG. 15 is a simplified, schematic diagram showing a part-region of a cross-section through a runner device with a structured top layer and inlaid elements to impart structure, seen in section along line XV—XV indicated in FIG. 14.
Figure 16:
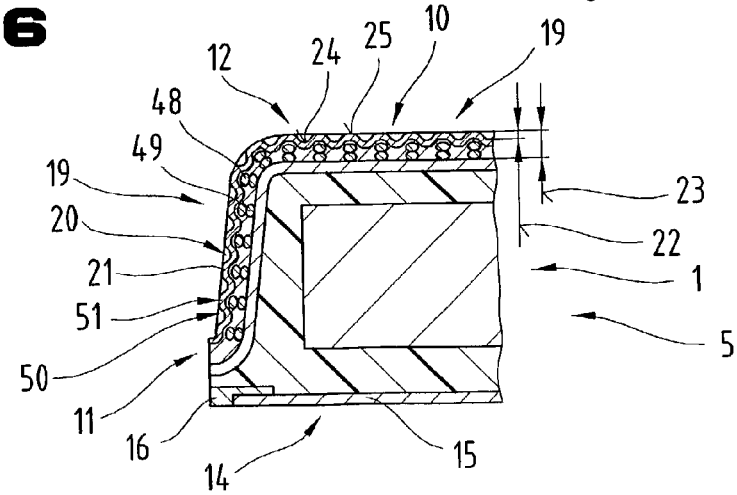
FIG. 16 is a simplified, schematic diagram showing a part-region of a cross-section through a runner device with a structured surface, which has shape-imparting elements underneath.

FIGS. 14 to 16 illustrate another embodiment of the runner device 1 and its structured top layer 10 on the external face 18. In this case, the surface structure in the top layer is not produced by a compression moulding or stamping process, but by structure-imparting elements 48, 49 joined to the to layer 10. The structure of the elements 48, 49 therefore determines the structured surface 19 of the top layer 10, at least to a certain extent. As seen in FIG. 15, these elements 48, 49 may be at least partially or totally embedded in the plastics material of the top layer 10. As illustrated in FIG. 16, the top layer 10 may be joined to the structure-imparting elements 48, 49 but only in a positive fit, in particular by bonding or fusing the elements 48, 49 disposed in an aligned arrangement thereon.

The elements 48, 49 may be provided in the form of threads or fibres, for example, laid out in a defined or systematic pattern relative to one another. In particular, the elements 48, 49 should form a lattice 50 or coarse-meshed fabric 51 or interwoven arrangement. The individual elements 48, 49 may cross with one another at any angle or extend perpendicular to one another. The individual elements 48, 49 may be disposed in an integral interwoven arrangement or placed one on top of the other in layers, as would be the case with a known lattice 50 or grill pattern. A smooth transition between the elements 48, 49 may be obtained using a lattice 50 of sprayed plastics, for example.

The cross-over regions between the elements 48, 49 and/or the free spaces between the elements 48, 49 in conjunction with the to layer 10 or a plastics melt applied on top of the lattice 50 or fabric 15 will in any event produce the structured surface 19 of the runner device 1 with its numerous recesses 20 and raised areas 21.

The top layer 10 may thus be integrated with the structure-imparting elements 48, 49 in the form of a prefabricated component for the production of the runner device 1. Alternatively, the lattice 50 or the fabric 51 may also be integrated with the outer top layer 10 of the runner device 1 during the production process, in particular during the pressing process in which the sandwich element 5 is joined at high temperature, thereby producing the finely structured surface 19 of the runner device 1. By combining the shape-imparting elements 48, 49 or the lattice 50 or the fabric 51 with a superimposed layer of plastics, the plastics material may sink in the viscid plastic state and at least partially fill the free spaces between the elements 48, 49. Once the outer plastics layer forming the top layer 10 of the runner device 1 has cooled, the corresponding, finely structured surface 19 is preserved.

Optionally, the top layer 10 may be made from a transparent or translucent plastics material, so that the lattice 50 or fabric 51 lying underneath remains visible in the top layer 10, imparting an attractive overall appearance to the top layer 10, in particular giving the runner device 1 a finely structured relief-type surface 19.

The side of the top layer 10 remote from the structured surface 19 is preferably provided with decorative elements, which will remain visible through the outer top layer 10. These decorative elements may be applied by any of the methods known from the prior art. In particular, the decorative elements may be applied by means of sublimation heat or a thermal diffusion process or in the form of a decorative film, or may be applied as several decorative layers of lacquer. Instead of providing reverse-face decoration or graphic designs on the top layer 10, it would also be possible to provide graphic decoration on its external face 18, although any decoration applied in this manner could be slightly damaged by external influences or could be more easily scratched.

For the sake of good order, it should finally be pointed out that in order to provide a clearer understanding of the design of the runner device 1 and the structure of the top layer 10 and/or the running surface lining 15, it and its constituent parts have been illustrated out of scale to a certain extent and/or on an enlarged and/or reduced scale.

The tasks underlying the independent inventive solutions can be found in the description.

Above all, subject matter relating to the individual embodiments illustrated in FIGS. 1; 2; 3, 4; 5; 6; 7; 8; 9; 10; 11, 12; 13; 14, 15; 16 can be construed as independent solutions proposed by the invention. The tasks and solutions can be found in the detailed descriptions relating to these drawings.

The invention claimed is:

1. A ski, jumping ski or snowboard comprising a running surface lining, a top layer and several layers disposed between the running surface lining and the top layer, the running surface lining, the top layer and the several layers disposed therebetween forming a sandwich with a core disposed between the layers, and the running surface lining and the top layer having an external face facing away from the core, wherein the external face of the top layer has means providing a visually pleasing looking ski, jumping ski or snowboard with enhanced aerodynamics, said means comprising a structured surface with 200 to 1000 recesses per square decimeter, the structured surface extending over the entire external face, the recesses having a closed bottom and a depth smaller than the thickness of the running surface lining and the top layer, and circumferential rounded transition regions extending between the closed bottom and the external face, the rounded transition regions having arcuate contour which is convex relative to the external face.

2. The ski, jumping ski or snowboard of claim 1, wherein the structured surface of the external face of the top layer has about 600 recesses per square decimeter.

3. The ski, jumping ski or snowboard of claim 1, wherein the ratio of a raised area of the structured surface to a recessed area thereof is about 1:1.

4. The ski, jumping ski or snowboard of claim 1, where a recessed area of the structured surface is larger than a raised area thereof.

5. The ski, jumping ski or snowboard of claim 1, wherein the ratio of a recessed area of the structured surface to a raised area thereof is about 1.2:1 to 2:1.

6. The ski, jumping ski or snowboard of claim 1, wherein the recesses have a surface dimension of 4 to 12 square millimeter, as seen in a plan view.

7. The ski, jumping ski or snowboard of claim 1, wherein the recesses have a surface density varying continuously in a longitudinal extension of the ski, jumping ski or snowboard, and the variation of the surface density varies several times.

8. The ski, jumping ski or snowboard of claim 1, wherein the recesses have a surface density decreasing from a front end of the ski, jumping ski or snowboard to a rear end thereof, seen in a direction of travel.

9. The ski, jumping ski or snowboard of claim 1, wherein the recesses have a surface density decreasing in a direction transverse to a longitudinal extension of the ski, jumping ski or snowboard.

10. The ski, jumping ski or snowboard of claim 1, wherein the external face of the top layer is planar in a front end and a binding mounting region of the ski, jumping ski or snowboard.

11. The ski, jumping ski or snowboard of claim 1, wherein the recesses within a limited surface unit are differently shaped.

12. The ski, jumping ski or snowboard of claim 1, wherein the external face of the top layer is profiled transversely to a longitudinal extension of the ski, jumping ski or snowboard, forming at least one cambered strip and groove-shaped indentation therein, the indentation extending in the longitudinal extension.

13. A multi-layer ski, jumping ski or snowboard comprising a top layer of transparent or translucent plastics, the layers forming a sandwich with a core disposed between the layers, the top layer having an external face facing away from the core and having means providing a visually pleasing looking ski, jumping ski or snowboard with enhanced aerodynamics, said means comprising a structured surface comprised of raised areas having 200 to 1000 recesses per square decimeter therebetween, the raised areas exhibiting a different transparency to light than the recesses, the structured surface extending over the entire external face, the recesses having a closed bottom and a depth smaller than the thickness of the top layer, and circumferential rounded transition regions extending between the closed bottom and the external face, the rounded transition regions having an arcuate contour which is convex relative to the external face.

14. A multi-layered ski, jumping ski or snowboard comprising a running surface lining, a top layer and several layers disposed between the running surface layer and the top layer, the running surface lining, the top layer and the several layers disposed therebetween forming a sandwich with a core disposed between the layers, the running surface lining and the top layer having an external face facing away from the core, wherein the external face of the top layer has means providing a visually pleasing looking ski or snowboard with enhanced aerodynamics, said means comprising a structured surface extending over the entire external face and is comprised of raised areas having 200 to 1000 recesses per square decimeter therebetween, the raised areas exhibiting a different transparency to light than the recesses, the recesses having a closed bottom and a depth smaller than the thickness of the top layer, and circumferential rounded transition regions extending between the closed bottom and the external face, the rounded transition regions having an arcuate contour which is convex relative to the external face, the top layer having the structured surface being a prefabricated plastics component hot-pressed to the several layers to form the ski, jumping ski or snowboard.

* * * * *